US005078041A

United States Patent [19]

Schmued

[11] Patent Number: 5,078,041

[45] Date of Patent: Jan. 7, 1992

[54] SUSPENSION BRIDGE PICKUP FOR GUITAR

[76] Inventor: Laurence C. Schmued, Rte. 18, Box 39, Charlottesville, Va. 22901

[21] Appl. No.: 532,594

[22] Filed: Jun. 4, 1990

[51] Int. Cl.[5] ..... G10H 3/18

[52] U.S. Cl. ..... 84/731; 84/DIG. 24

[58] Field of Search ..... 84/731, DIG. 24

[56] References Cited

U.S. PATENT DOCUMENTS 4,211,139 7/1980 Murakami .
4,228,715 10/1980 Nourney .
4,491,051 1/1985 Barcus .
4,567,805 2/1986 Clevinger .
4,632,002 12/1986 Clevinger .
4,697,491 10/1987 Maloney .
4,750,397 1/1988 Ashworth-Jones .

FOREIGN PATENT DOCUMENTS 885961 11/1970 Canada .

*Primary Examiner*—Stanley J. Witkowski
*Attorney, Agent, or Firm*—Ralph F. Crandell

[57] ABSTRACT

A suspension bridge pickup mechanism for stringed musical instruments. Vibrations from the strings are transferred to a suspended bridge which is in contact at spaced points with resonator plates of a plurality of bimorphic piezoelectric elements. The bridge has a high length to transverse thickness ratio resulting in a signal of wide frequency range and high amplitude. The tonal characteristics and the relative harmonic content of the signal can be altered by selecting or rejecting specific transducers which will contribute to the output signal utilizing a switching circuit. The transducers may be positioned under different portions of the bridge resulting in greater low frequency response in the median region of the bridge, maximal mid frequency response in the paramedian region, and maximal high frequency response near the ends of the bridge. Resonator plates of large area and small thickness are employed for maximal reproduction of low frequencies and resonator plates of small area and greater thickness are employed for maximal reproduction of high frequencies. The instrument strings cross and are supported by the bridge asymmetrically of its length.

10 Claims, 3 Drawing Sheets

SUSPENSION BRIDGE PICKUP FOR GUITAR

BACKGROUND OF THE INVENTION

1. Field of the Invention

The present invention relates to a piezoelectric bridge mounted pickup for stringed musical instruments. More specifically, the invention relates to a bridge mounted pickup which converts the vibrations of the resonating strings to an electrical signal by mechanically coupling the resonating strings to piezoelectric transducers.

2. Brief Description of the Prior Art

Since the introduction of the piezoelectric crystal microphone in the 1930's, investigators have been trying to incorporate them into musical instruments. The results were generally disappointing as the output was low and the tendency to feedback was high. Therefore, when the coil/magnet induction pickup was developed in the 1940's, it was widely adopted by musicians wanting to amplify their steel stringed instruments. Perturbations of the magnetic field caused by the resonating string results in a current induced in the coil. Therefore, these pickups measure only indirect string vibration. It is not surprising that these electro-magnetic pickups only minimally reflect the properties of the bridge and sounding board.

The piezoelectric transducer, however, can be located in a position so as to be more influenced by the acoustics of the sounding board as well as the summed interaction of the strings via the bridge. Over the last decade several investigators have patented bridge mounted piezoelectric pickups, presumably to provide increased output and decreased feedback.

Relevant examples of previous work include Murakami U.S. Pat. No. 4,211,139 to Murakami, which discloses a rigid bridge sitting directly on, and a piezoelectric element underneath, a thick vibration transmitter plate supported lengthwise by shock absorbing brackets. Another essentially rigid design is described in U.S. Pat. No. 4,491,051 to Barcus, in which a solid bridge or saddle member sits flush on top of a pickup unit which contains piezoelectric crystals. Clevinger has introduced several designs which involve a somewhat flexible bridge with essentially fixed ends. Both U.S. Pat. No. 4,567,805 and U.S. Pat. No. 4,632,002 to Clevinger describe pickups in which vibration damping pads interface between the bridge and the plate resonator, and the plate resonator and the base of the unit. U.S. Pat. No. 4,750,397 to Asbworth-Jones describes a pickup in which the periphery of a bimorphic transducer is secured via two mounting pads to the underside of the transverse bridge support, while a malleable pad or bead contacts the entire underside of the transducer and the underlying base of the unit.

Although the devices shown in most of the aforementioned patents incorporate the use of multiple piezoelectric transducers to detect the vibrations of a multitude of strings, the final output is always the sum of the individual transducers. They do not provide a switching circuit whereby the individual transducer signals can be selected or rejected selectively. The aforementioned patents also do not attempt to detect signals with different harmonic components by using resonator plates of different dimensions and by situating them under different portions of the resonating bridge including regions not directly under the strings. All of the aforementioned pickup units which incorporate bimorphic piezoelectric elements employ resonator plates supported or contacted by malleable dampeners which presumably minimize unwanted microphonics. However, the use of these dampeners results in a signal of degraded frequency range, amplitude, and sustain. Only Clevinger U.S. Pat. No. 4,567,805 and U.S. Pat. No. 4,632,002 describes pickup units which can adjust bridge/string height or can adjust for proper intonation by altering the distance between the bridge and tuning mechanism.

OBJECTS AND SUMMARY OF THE INVENTION

It is the principal object of this invention to enable vibrations with a wide range of harmonic overtones, created at different points along a resonating bridge, by the strumming, plucking or bowing of the strings, to be transmitted with minimal damping to the piezoelectric elements and thereby converted by such elements into electric signals transmitted in turn to switches so that the player of the instrument may mix the signals and choose thereby which vibrations are to be converted into sound.

This invention is an electric pickup for stringed musical instruments which is unique in that it can produce a sound of long sustain, high amplitude, wide frequency range, harmonic complexity and multi-output. The uniquely attractive sound produced by the present invention is the result of linking a relatively freely resonating bridge with relatively freely resonating transducers. The bridge in this invention comprises a resonating bridge of elongated shape, that is, relatively long in proportion to its transverse cross section, and so tends to resonate along its length more freely than a bridge which is rigid and which would tend to vibrate with decreased amplitude and poor low frequency reproduction. Additional freedom of motion for the bridge in two dimensions results from the lack of a rigid attachment at the ends of the bridge.

In conventional fashion, the usual plurality of strings is attached to the instrument frame or sounding board and tensioned over and against the surface of the bridge of this present invention. The vibrations which are set up in each string, typically by plucking or bowing, therefore vibrate the bridge via the area of contact between the string and the bridge surface. The vibrations set up in the bridge by any one string are strongest at its area of contact and the bass frequencies fade according to the distance along the bridge away from that area.

In a multiple-stringed instrument the vibration of the bridge at any point on its length will be a mixture of interactions of the vibrations from the strings then resonating or being played. This effect is known as cross talk and is generally a desirable effect produced by coupling strings via the bridge and sounding board. The production, as described, and the ability to select and mix tones of different harmonic content/cross talk are primary purposes of this invention. The selective mixing is achieved by tapping the vibrations of the bridge along its length.

In a presently preferred embodiment of the invention, the taps are in the form of studs which exit the bridge and contact underlying plate resonators, each supported around its perimeter by a threaded support element which is screwed into the body of the instrument, or into a platform of adjustable height. The plate resonators generally are of different thickness or width to modify further the frequency response characteristics, those which are thinner and those which have greater surface area being nearer the center of the bridge where the amplitudes of the vibrations tend to be greater and the frequency lower. The taps efficiently transmit vibrations from points on the bridge to underlying plate resonators to which the piezoelectric element is attached.

On the surface of each plate resonator opposite to that on which the taps bear, a piezoelectric element is attached which converts the vibrations received from the bridge via the taps into an electric signal the strength of which varies according to the varying amplitude of the bridge vibrations. The assembly of plate resonator, piezoelectric element and perimetric support is referred to collectively as a transducer. The vibrations are converted to an electric signal by making contact with the transducer, and the electric signal is transmitted to an amplifier which is used by all electric musical instruments. The signals representing the vibrations of different parts of the bridge may be selected and mixed, or rejected, respectively. This mixing or rejection cannot be achieved by acoustic instruments, which have no means of selecting different modes of vibration, or by electric musical instruments where the bridges are rigid or rigidly supported elements of relatively large cross sections compared with their respective widths, or are without multiple taps acting upon separate piezoelectric transducers.

In a preferred embodiment of this invention, the bridge is located and supported by two studs, one at a short distance from each end of the resonating bridge, which tap into a transducer and thereby not only support the resonating bridge suspended above the body or sounding board, in a way which permits relatively free resonance of the bridge, but also transmit bridge vibrations to their respective transducers.

Two bolts are also provided which extend a short distance through either end of the bridge and permit it to be adjusted towards or away from the neck, or its equivalent, of the instrument. These bolts are mounted in clearance holes in a metal support plate or rod. Each bolt axis may move through a small angle relative to the axis of the clearance hole. This ability, and the fact that the bridge can vibrate about the circumference of each bolt where it passes through the resonating bridge, permit the bridge to resonate with little restriction from the adjusting bolts.

Although tonal agreeability is by nature subjective, certain physical properties of sounds are often associated with an aesthetic sound. The present invention maximizes the frequency range, the amplitude, the sustain, the harmonic overtone content, the range of intonation, and the resonance of the signal. This is accomplished by using a bridge which is of much greater length relative to its height. This assures a very pliant and flexible bridge capable of good low frequency reproduction and high amplitude output. The flexibility of this suspended bridge is maintained by employing small diameter acoustic taps to transfer the vibrations from the bridge to the underlying transducers. Since dampeners are not used, in contact with the resonator plates of the bimorphic transducers, there is minimal loss of high frequencies, volume, or sustain.

This invention also promotes wide frequency response and high amplitude output as a result of the freedom of the ends of the bridge to move in two dimensions including in a direction perpendicular to the sounding board. A wide frequency response and a harmonic fullness is the result of using multiple transducers designed to reproduce different harmonic components of the signal.

To provide the ability to include or reject signals of disparate relative harmonic content in the final output, the present invention utilizes transducers capable of differentially responding to different ranges of harmonic overtones generated by the resonating strings. In order to accentuate the differences in the relative harmonic composition of the signals generated by the respective transducers, acoustic vibrations are transferred from different portions of the bridge which resonate optionally at different frequencies. To this end, transducers are situated near the central portion of the bridge which respond optimally to low frequencies, while transducers which are situated to receive vibrations from the end regions of the bridge will respond maximally to higher frequencies. Alternately to maximize the harmonic diversity between the transducers, the piezoelectric elements are attached to resonator plates of differing area and thickness. Transducers designed to respond maximally to low frequencies incorporate large, thin resonator plates, while those transducers which respond primarily to high frequencies employ small thick resonator plates. By utilizing a switching circuit it is possible to select or reject any combination of transducers contributing to the output signal. This results in a great variety of tonal outputs.

This invention further embodies a feedback compensation device which eliminates feedback even under conditions of very high amplification. Such a device consists of two or more air suspended transducers mounted back to back. This device, when connected in parallel through switch or potentiometer with the output of the mounted transducers, is effective to eliminate feedback.

This invention also incorporates a bridge linked piezoelectric pickup in which both the height of the bridge and the distance between the bridge and tuning mechanism is fully adjustable.

DESCRIPTION OF THE PREFERRED EMBODIMENTS

The present invention is embodied in an improved electric pickup and bridge mechanism for a stringed musical instrument of the type having a sounding board, strings supported on the bridge, means for tightening the strings, and a switching circuit for selecting and mixing electric signals produced by the pickup as a result of the vibration of said strings to produce a variety of sounds of diverse harmonic complexity. This complexity of sound is achieved by the unique pickup and bridge mechanism, which includes a plurality of acoustic taps in contact with the bridge and pickup transducers. The pickup transducers sense the various vibrations created by the strings along the length of the bridge. The invention finds particular but not exclusive utility for use in or on solid body or hollow body guitars.

Figure 1:
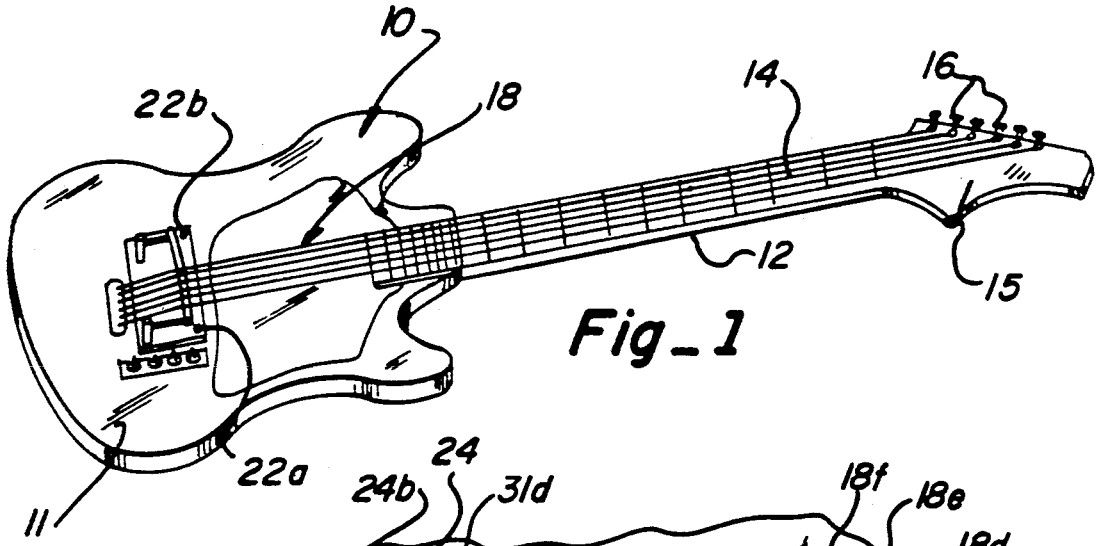
FIG. 1 is an isometric view of a guitar with a bridge embodying the present invention.

As shown in FIG. 1, a solid body guitar 10 is formed by a solid sounding board 11 having an elongated neck 12 extending therefrom to provide a fingerboard 14 and peghead or head 15, with tuning plugs or gears 16 mounted on the head 15 for tightening adjusting or loosening and thereby the tension on strings 18 extending along the neck over the fingerboard. The individual strings 18*a*, 18*b*, 18*c*, 18*d*, 18*e* and 18*f* of a six string guitar are secured at one end to the respective tuning gears 16 on the peghead 15 and at the other end to a mounting bracket 19 on the guitar body 11 adjacent a bridge assembly 20 embodying the present invention and adjustably supported on top of or recessed into the guitar body or sounding board 11.

The resonating bridge assembly 20 is formed by a support board or base plate 21 supported on or recessed within the guitar sounding board 11 by three mounting screws 22*a*, 22*b* and 22*c*, threadably engaged through the plate 21. Reference to mounting of the plate on the guitar includes both surface and recessed mounting configuration. The elevation and attitude of the base plate 21 on the guitar body 11 may be adjusted by turning the mounting screws, which supportingly engage the sounding board 21. The bridge assembly 20 is held tightly against the body of the instrument 11 by the mounting screws and the tension of the guitar strings 18 passing over and supported on the bridge. The bridge 24 is elongated and may be circular or of other geometrical shape in cross section. While the bridge is conveniently defined as being cylindrical, it is understood that it is not limited to a circular cross section.

The bridge 24 effectively forms a floating elongated transversely arcuate bridge extending transversely of the base plate 21 and strings 18. The bridge supportingly engages each of the strings 18*a*, 18*b*, 18*c*, 18*d*, 18*e* and 18*f* generally asymmetrically with respect to its length , that is nearer one end of the bridge than the other. The bridge 24 provides a curved, rounded upper string supporting surface 25 and is supported or positioned on and above the base plate 21 by a pair of spaced apart cantilever extension bolts 25*a*, 25*b* extending generally parallel to the strings 18 and threadably engaged at one end through correspondingly threaded aperture in the elongated bridge 24 adjacent each end thereof. At their other ends, the cantilever bolts are swingably supported in apertures 26 defined in the upper ends of vertical support posts 28*a*, 28*b* threadably mounted on the base plate 21.

The cantilever extension bolts 25*a*, 25*b* can swing through a small conical angle relative to the vertical support posts 28*a*, 28*b*. The angle may be about 15 degrees or less in any direction, although movement is generally confined to a vertical plane when the bolts are engaged with the bridge 24, whereby the bolts provide a minimal restraint on the resonation of the bridge 24. By turning the cantilever extension bolts, the position of the bridge 24 relative to the strings may be longitudinally adjusted.

The elongated bridge 24 is cylindrical or polygonal in cross section and is curved at a shallow radius. The strings are positioned across the bridge closer to one end 24*a* than the other. The high point of the bridge located midway of the strings, providing a generally asymmetric bridge configuration.

Figure 7:
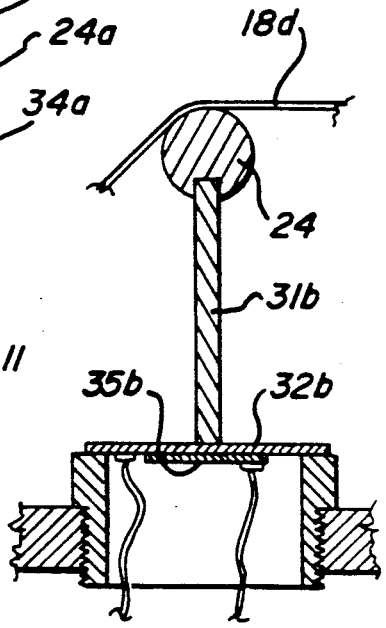
FIG. 7 is a section view taken substantially in the plane of line 7—7 on FIG. 4.
Figure 8:
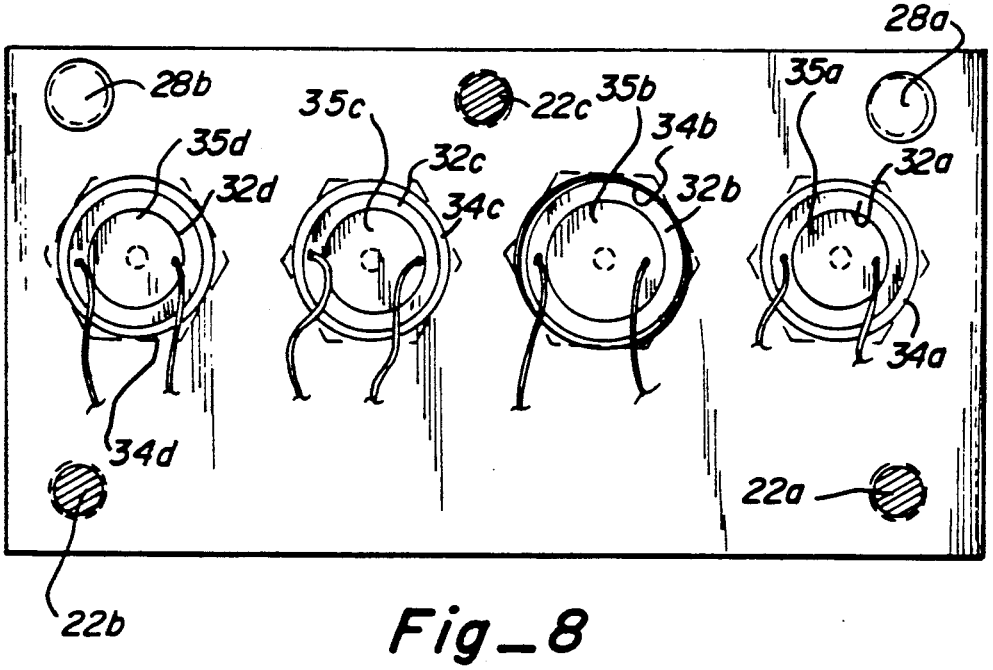
FIG. 8 is a bottom plan section view of the bridge assembly taken substantially in the plane of line 8—8 on FIG. 4.

For picking up vibrations from the bridge 24 as the strings are plucked or bowed, four or more transducer assemblies 30*a*, 30*b*, 30*c* and 30*d* are mounted on the base plate underlying the bridge 24 and are operatively and supportingly coupled to the bridge 24 by stud or pin acoustic taps 31*a*, 31*b*, 31*c*, and 31*d* respectively. The transducer assemblies 30*a*, 30*b*, 30*c* and 30*d* each comprise respectively a plate resonator 32*a*, 32*b*, 32*c*, and 32*d*, in the form of a grounded, thin, resilient metal plate peripherally supported on an externally threaded mounting sleeve 34*a*, 34*b*, 34*c* and 34*d*, each sleeve being threadably supportive in a tapped apertures in the base plate 21 as shown in FIG. 7. Each acoustic tap 31*a*, 31*b*, 31*c* and 31*d* couples a respective plate resonator 32*a*, 32*b*, 32*c* and 32*d* to the bridge 24, the outermost two taps 31*a* and 31*d* also serving as outboard bridge supports. Piezoelectric elements 35*a*, 35*b*, 35*c* and 35*d* are secured respectively to the undersurface of a and each piezoelectric element is in turn electrically coupled to a switch 36*a*, 36*b*, 36*c* and 36*d* for selecting and mixing electric signals from said piezoelectric elements and transmitting the signals to an external amplifier 39 and speakers 40 (FIG. 8).

Figure 2:
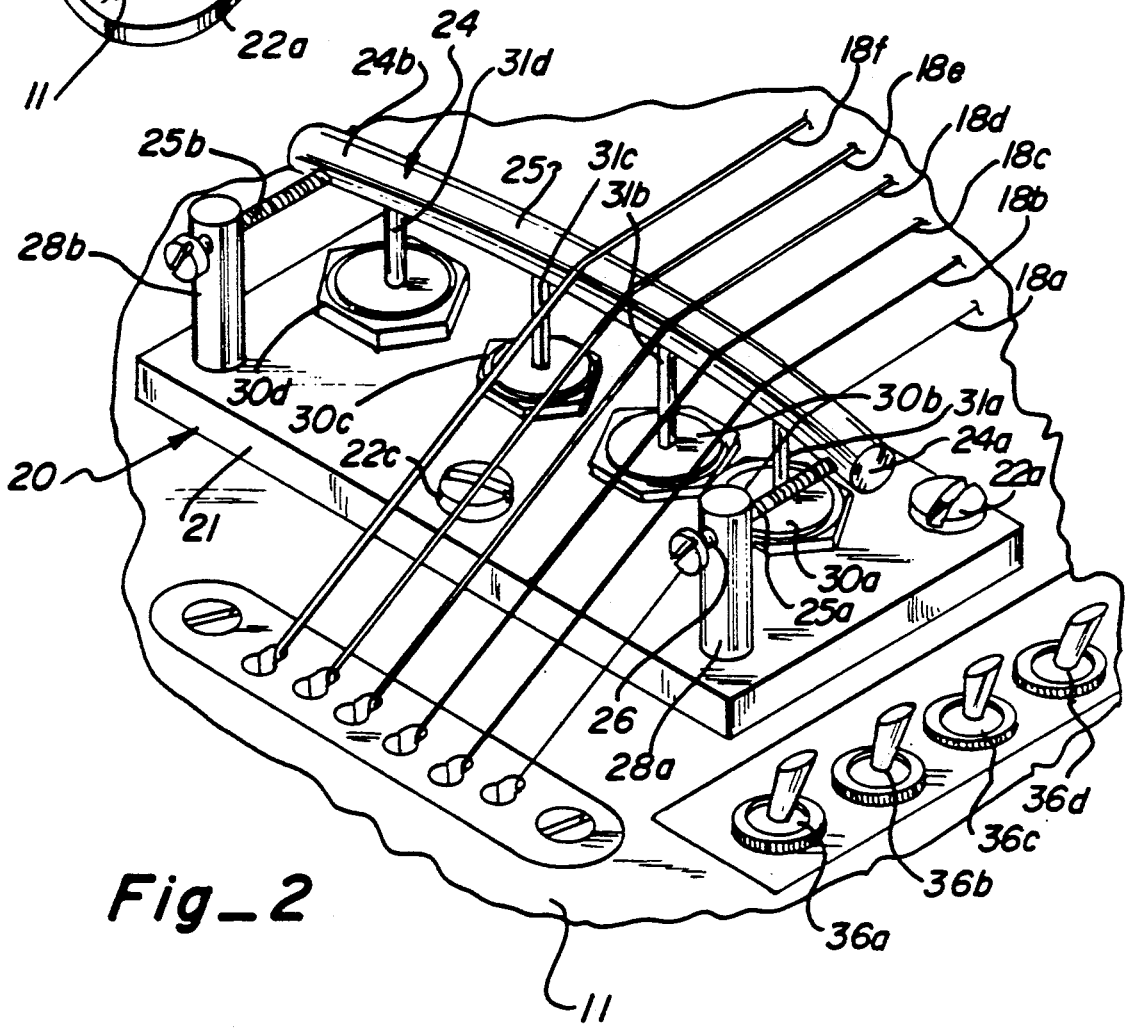
FIG. 2 is an elongated isometric view of a bridge embodying the present invention as shown in FIG. 1.

As shown in FIGS. 1 and 2, the strings 18 of the musical instrument pass over the bridge 24 asymmetrically thereof. In the embodiment illustrated, the support board or plate 21 is installed on a six-stringed instrument, and uses four transducers, two central transducers 30*b* and 30*c*, and two end transducers 30*a* and 30*d*. The strings 18 pass over the portion of the bridge 24 in juxtaposition with two of the transducers 30*a* and 30*b*. Only the large bass transducer 30*b* is directly under the strings, transducers 30*a* and 30*c* being positioned just to either side of the strings.

Figure 3:
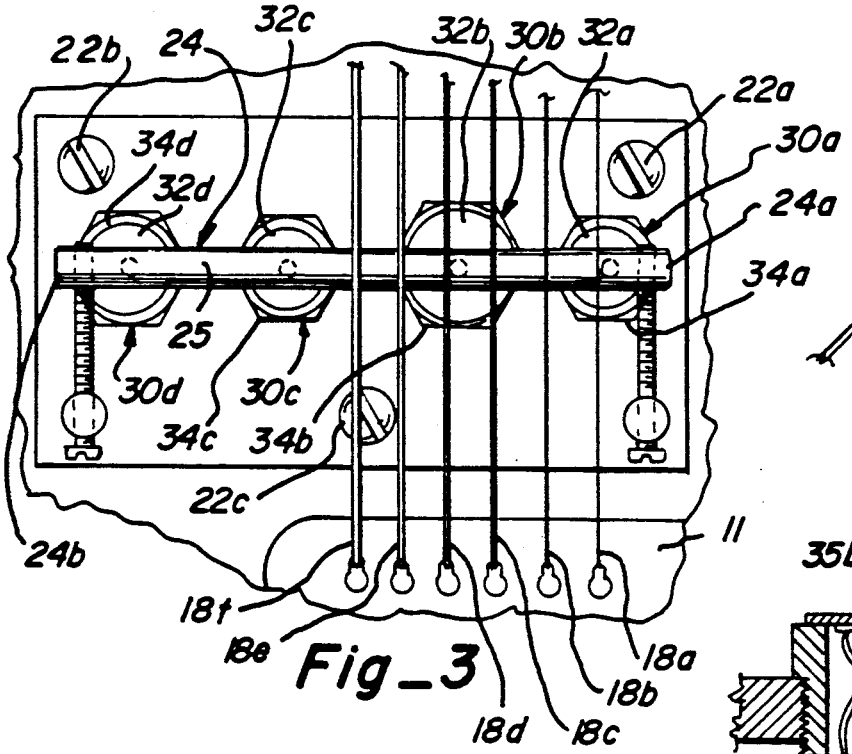
FIG. 3 is a top plan view of the bridge shown in FIG. 2.
Figure 4:
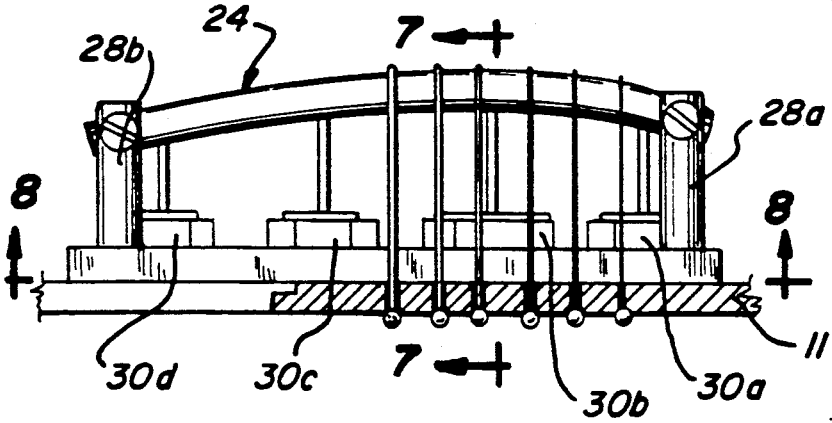
FIG. 4 is a front elevation view of the bridge shown in FIG. 3.
Figure 5:
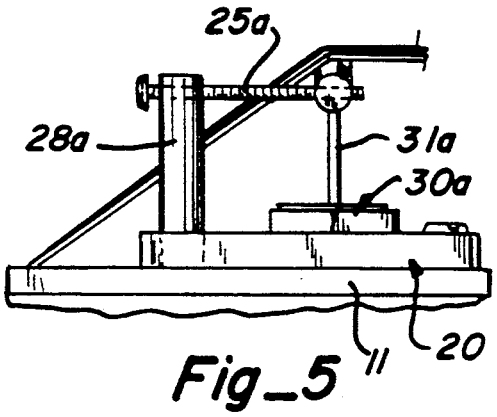
FIG. 5 is a right side elevation view of the bridge shown in FIG. 3.
Figure 6:
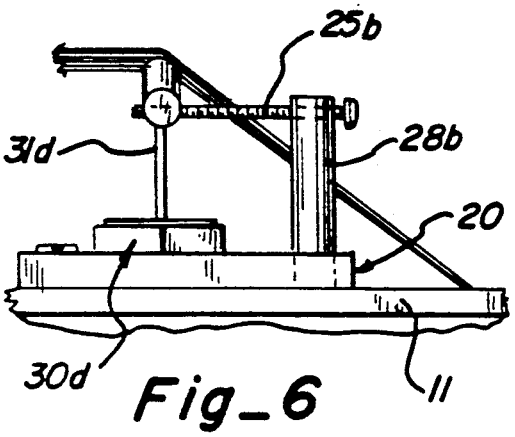
FIG. 6 is a left side elevation view of the bridge shown in FIG. 3.

As shown in FIGS. 2, 3 and 4 the slim cylindrical resonating arcuate elongated bridge 24 has a length which may be approximately ten to twenty times the greatest lineal dimension of its transverse cross section, and is therefore capable of resonating more freely than a bridge of thicker, more rigid form. The purpose of the form of resonating bridge according to this invention is to convert the vibrations of the strings into vibrations of different harmonic content along with the resonating bridge itself. This is analogous to the mammalian ear in which different frequencies resonate the long basilar membrane differentially along its length, differentially stimulating underlying electro-mechanical sensory cells.

While the preferred embodiment utilizes four acoustic support taps 31*a*, 31*b*, 31*c* and 31*d*, with two of the taps acting as bridge support taps arranged along the resonating bridge underside at right angles to the support board 21, this configuration is for example only, and any number of acoustic taps may be employed, each adapted to transmit vibration from the area of the resonating bridge in which the tap is arranged to a respective plate resonator with which the tap is in contact. That is, the purpose of the acoustic taps is to transmit the vibrations with differential harmonic components at the respective points at which the bridge is tapped.

All the plate resonators 32*a*, 32*b*, 32*c* and 32*d* employed in this invention are small and relatively thin in comparison with the dimensions of their faces. For example, in their preferred form, the resonators are of a hexagonal or circular disc shape. The diameter of a plate resonator utilized would not exceed about 1.5 inches in length and about 0.05 inch in thickness. One purpose of the plate resonators is to receive the respective harmonic frequencies from the acoustic taps and resonate accordingly. The plate resonators 32*a*, 32*b*, 32*c* and 32*d* are supported peripherally, which leaves all central portions of the plate resonators within their perimeters free to resonate with low damping effect under the action of vibrations transmitted through the acoustic taps which bear on the upper sides of the resonator plates. The contact pressure of the taps on the plate resonators also has the effect of preventing feedback arising from random vibration of the plate resonators under the influence of vibrations other than those transmitted from the resonating bridge.

The peripheral or perimetric support sleeves may be of various forms. The embodiments shown in the drawings are in the form of externally threaded hollow sleeves or tubes. The piezoelectric elements mounted on the lower or undersurface of each resonator plate generate electric signals when such elements are flexed by the vibrations of the plate resonators. The piezoelectric elements convert vibrations tapped from the resonating bridge by the acoustic taps and received by the plate resonators into corresponding electric signals. In the circuit shown in FIG. 8, piezoelectric elements 35*a*, 35*b*, 35*c* and 35*d* each have a contact point 38*a*, 38*b*, 38*c* and 38*d* respectively which is connected to a corresponding switch, 36*a*, 36*b*, 36*c* and 36*d*. The switches enable the selection and mixing of the electric signals from the plurality of piezoelectric elements and transmission of said electric signals to the external amplifier in order to produce a sound of harmonic complexity and diversity.

Although the resonating bridge 24 may be supported by various means, it is preferably always supported at two spaced apart points disposed on either side of and remote from its center, as shown in FIG. 2.

Figure 9:
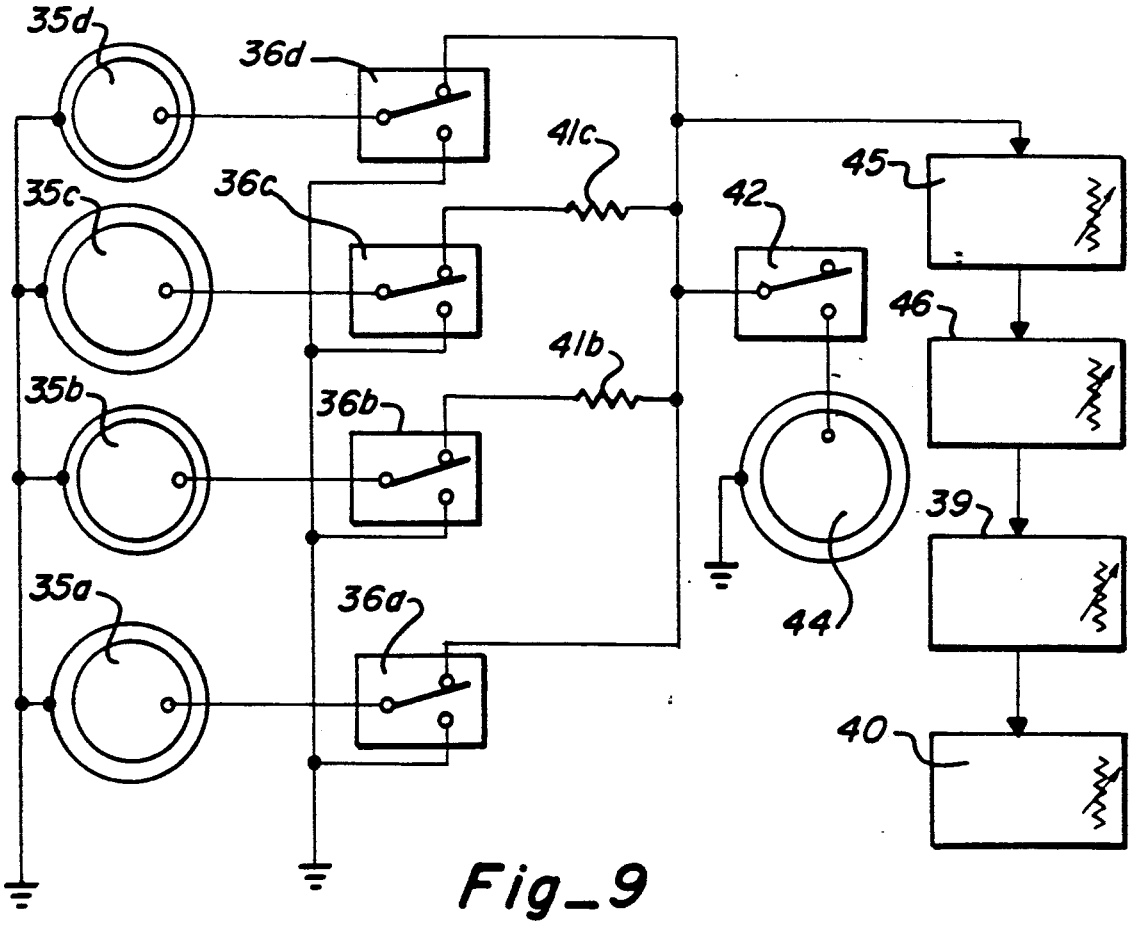
FIG. 9 is a schematic diagram of an electrical circuit utilized with a bridge embodying the present invention.

It is a novel feature of this invention that the vibrations, including cross talk, induced at different points along the resonating bridge by plucking or bowing the strings may be tapped from those points and transmitted to the amplifier via this improved pickup with an absence of avoidable damping, so that, by operating the switches 36*a*, 36*b*, 36*c* and 36*d* the player of the instrument may determine which vibrations shall be mixed and converted into sound. As shown in FIG. 9, between the selector switches and the external amplifier 39 and speakers 40, there are a number of optional circuits. The central transducers, 30*b*, 30*c* may be connected with normalizing resistors 41*b*, 41*c* to reduce their output to levels comparable with the lateral transducers, 30*a*, 30*d*. Another option is a feedback control circuit which consists of a switch 42 or potentiometer which couples two or more transducers 44 positioned back to back and unmounted or air suspended, in parallel with the summed output of the piezoelectric pickup elements of the instrument. The purpose of this circuit is to eliminate feedback when high levels of amplification are employed. Other optional passive circuits which may be included within the musical instrument are conventional volume 45 and tone 46 circuits.

In the embodiment shown in FIG. 2 the bridge 24 is supported above the support board 21 by the end taps 31*a*, 31*d*, which transmit vibrations to the end transducers 30*a*, 30*d*. The inner taps 31*b*, 31*c* serve the exclusively acoustic function of transmitting the vibrations from the bridge 24 to the medial transducers 30*b*, 30*c*. Protruding from the underside of the bridge, the central acoustic taps 31*b*, 31*c* contact the respective plate resonators 32*b*, 32*c* of transducers 30*b*, 30*c* respectively for the purpose of transmitting vibrations from the resonating bridge via respective plate resonators. Any number of transducers disposed along the resonating bridge may be employed in contact with respective acoustic taps, of which there may also be any number, to tap the vibrations from the various points on said resonating bridge. The respective piezoelectric elements may be of any thickness or surface area which can be accommodated in the space available therefor. However, it is preferable to use plate resonators of relatively thick section and low surface area, which resonate at higher frequencies and lower amplitudes, in contact with taps transmitting vibrations from parts of the resonating bridge which resonate at such higher frequencies and lower amplitude, that is, near the ends of the resonating bridge. Near the center of the resonating bridge, where lower frequencies and higher amplitudes of vibration are produced, plate resonators of thinner section and larger surface area with lower resonant frequencies and higher amplitudes are more advantageously employed. By such choice of plate resonator dimensions, the fullest possible range of vibrations generated in the resonating bridge by the strings is transmitted to the transducers and thence to the conventional amplifier circuit. A greater thickness of the lateral plate resonators 32*a*, 32*d* on which the bridge support taps 31*a*, 31*d* are respectively attached is advantageous to transmit the higher resonating bridge frequencies present nearer the bridge supports, and to supporting the bridge 24 under the force applied thereon by the tensioned strings 18. Both the position of the plate resonator relative to the bridge and the dimensions of the plate resonator will influence the harmonic components of the output signal.

As can readily be appreciated by those skilled in the art, the combination in this invention of the resonating bridge 24 with any of the perimetrically supported plate resonators forms a resilient spring or resonator which mechanically couples the respective strings 18*a*, 18*b*, 18*c*, 18*d*, 18*e*, 18*f* to the respective piezoelectric element attached to such plate resonator.

It is a novel feature of this invention that the combined effects of the vibrations of the plurality of strings, being plucked or bowed, can be tapped from any points, determined at the time of manufacture of the pickup according to this invention, on the resonating bridge 24 and converted without avoidable damping, via the respective plate resonator, by the respective piezoelectric element into electric signals which may be taken from the contact point on each such piezoelectric element, selected and mixed by conventional circuitry of contacts and switches, as schematically shown in FIG. 3, and the mixture of signals transmitted thereby to the amplifier 39 and speakers 40 for conversion into sound.

Although the embodiment illustrated contains four transducers, this number is arbitrary, as any number may be employed. In the modification shown, one transducer located centrally under the strings has a thin, high surface area resonator which will produce the signal with the most low frequency harmonic content. In contrast, other transducers are located near the ends of the bridge 24 and have thick, low surface area resonators to maximize the high harmonic content of the signal. These respective outputs of a plurality of transducers can be mixed in parallel to expand the range, harmonic overtone, and phase complexity of the output signal. The final subjective result of the aforementioned pickup is a tone that is full, resonant, solid and loud. Even with a solid sounding board, this pickup will produce a full sound reminiscent of an acoustic instrument. Subjective tonal quality will depend on the transducer or transducers contributing to the output signal. For example, one transducer will produce a thin bright sound, another transducer will produce a full warm sound, another transducer will produce an intermediate sound, and mixing all three will resulting a tone of full spectral qualities and enhanced resonance.

While the invention has been described in connection with the presently preferred embodiments, it will be understood that it is not intended to limit the invention to these embodiments. On the contrary, it is intended to cover all alternatives, modifications and equivalents as may be included in the spirit and scope of the invention as defined in the appended claims.

I claim as my invention:

1. An improved electric pickup for a stringed musical instrument of the type having a body defining a sounding board, a plurality of strings, means for adjusting the tension of said strings, and a switching circuit for selecting and mixing electric signals produced by said pickup so as to produce a sound of diverse harmonic content and complexity, wherein the improvement comprises: a pickup support board, means for adjustably mounting said board on said musical instrument in juxtaposition with the strings thereof, an elongated resonating bridge for engaging said strings asymmetrically of its length and converting the vibrations therefrom into vibrations of different relative harmonic content along said bridge, means adjustably mounting said bridge on said support board, a plurality of acoustic taps arranged along the underside of said resonating bridge for tapping regions of said bridge which resonate with different proportions of harmonic overtones, a plurality of metal plate resonators, means perimetrically supporting said resonators adjustably mounted on said support board, each said resonator having an upper face arranged in contact with one of said acoustic taps for receiving said respective harmonic vibrations and minimizing microphonics and feedback from random resonation of said metal plate resonators, each of said resonators having a lower face, and a plurality of piezoelectric elements mounted one on each of the lower faces of said metal plate resonators for converting the vibrations of the respective metal plate resonators into electric signals adapted to be fed to said switching circuit.

2. A pickup as defined in claim 1 wherein said means for adjustably supporting said support board comprises three spaced apart bolts threadably engaged in said support board and adapted for supporting engagement with said instrument body.

3. A pickup as defined in claim 1 wherein said means for supporting said bridge comprises a pair of spaced apart threaded cantilever bolts extending generally parallel to said board and threadably engaged at one end in support posts mounted on said board, each said bolt being threadably engaged at its other end with one end of said bridge for adjustably supporting said bridge above said resonator plates.

4. A pickup as defined in claim 1 wherein said metal plate resonators arranged nearer the ends of said resonating bridge are smaller in the surface area of their said faces and thicker in lateral cross section than said metal plate resonators arranged nearer the center of said resonating bridge.

5. A pickup as defined in claim 1 wherein said bridge is arcuate and defines a rounded upper string engaging surface.

6. A pickup as defined in claim 1 wherein said bridge has a length of between ten and twenty times the greatest lineal dimension of its transverse cross section.

7. A pickup as defined in claim 1 wherein said bridge mounting provides for up to about a 15 degree vertically swinging movement.

8. A pickup as defined in claim 1 wherein said bridge is positioned under the array of strings with said string array being positioned closer to one end of said bridge than the other.

9. A pickup as defined in claim 1 further including a pair of air suspended piezoelectric elements mounted in back to back relationship and a second switching circuit including means connecting said pair of piezoelectric elements in parallel with the output of one or more of said piezoelectric elements to prevent feedback resulting from very high levels of external amplification.

10. An improved electric pickup for a stringed musical instrument of the type having a sounding board, an array of strings, means for adjusting the tension of the strings, and a switching circuit for receiving electric signals from said pickup and selecting and mixing said electric signals so as to produce a sound of diverse harmonic complexity, and for transmitting electric signals from said pickup to an external amplifier, wherein the improvement comprises:

an elongated, generally cylindrical resonating bridge for asymmetrically engaging said strings and converting the vibrations therefrom into vibrations of different relative harmonic content along said bridge, a plurality of acoustic taps extending in spaced apart relation from the underside of the said resonating bridge for tapping the different ratios of harmonic frequencies at the respective points tapped on said bridge and including end taps for supporting said bridge on said instrument;

a metal plate resonator having an upper face thereof in contact with one of said acoustic taps and arranged below the middle of said string array which is supported by said resonator bridge, a metal plate resonator having an upper surface thereof in contact with an acoustic tap located on the bass string side of said centrally disposed metal plate resonator, said centrally disposed metal plate resonator having a thinner lateral cross section and a greater total surface area on its upper and lower faces than those of said metal plate resonator located on the bass string side for receiving and maximizing the respective harmonic content of, and transmitting vibrations from the respective points of said bridge tapped of different amplitudes and harmonic overtone ratios, and for preventing feedback from random vibration of said metal plate resonators, and a metal plate resonator located adjacent each and of said bridge and in contact with and supporting said end taps, said end metal plate resonators having a thicker lateral cross section than said metal plate resonator arranged below the middle of said string array each of said metal plate resonators having a lower face;

a piezoelectric element mounted on each of the lower surfaces of said metal plate resonators, for converting the vibrations of said metal plate resonators into electric signals;

means for perimetrically supporting each of said metal plate resonators for resonation with low damping effect, and means adjustably mounting said supporting means on said instrument for adjusting the height of said bridge relative to said instrument.

* * * * *